US005140713A

United States Patent [19]

Pesterfield

[11] Patent Number: 5,140,713

[45] Date of Patent: Aug. 25, 1992

[54] BATH PILLOW

[75] Inventor: John B. Pesterfield, Cleveland, Tenn.

[73] Assignee: St. John Manufacturing Co., Inc., Cleveland, Tenn.

[21] Appl. No.: 840,339

[22] Filed: Feb. 24, 1992

[51] Int. Cl.[5] ..... A47K 3/00

[52] U.S. Cl. ..... 4/575.1; 5/652; 5/643

[58] Field of Search ..... 5/652, 643, 630, 644, 5/645; 4/575.1, 571.1, 573.1, 574.1, 579

[56] References Cited

U.S. PATENT DOCUMENTS

| | | | |
|---|---|---|---|
| 1,721,571 | 7/1929 | Miller | 4/575.1 |
| 1,844,576 | 2/1932 | Heintz | 5/643 |
| 1,898,272 | 2/1933 | Stern | 4/575.1 |
| 3,078,474 | 2/1963 | Chaitlen | 4/575.1 |
| 4,597,386 | 7/1986 | Goldstein | 5/643 |
| 4,731,891 | 3/1988 | Scheurer | 5/636 |
| 4,803,743 | 2/1989 | Greenawalt | 5/636 |
| 5,014,373 | 5/1991 | Dobine | 5/636 |

FOREIGN PATENT DOCUMENTS

| | | | |
|---|---|---|---|
| 452599 | 11/1948 | Canada | 4/575.1 |
| 374165 | 10/1959 | Switzerland | 4/575.1 |

*Primary Examiner*—Renee S. Luebke
*Assistant Examiner*—F. Saether
*Attorney, Agent, or Firm*—Alan Ruderman

[57] ABSTRACT

A bath pillow for use as a head rest within a bathtub has an outer casing enclosing a resilient plastic foam filler. The casing includes a front covering and a rear covering secured together at respective peripheral edges corresponding to the peripheral configuration of the pillow. A sheet of film is disposed between the front and rear coverings and secured to the peripheral edges thereof. A resilient suction cup is secured to the sheet of film and projects outwardly from the rear covering so that the film and the front covering provide a water impervious enclosure about the foam filler, and the detaching force is not applied directly to the rear surface but is applied to the film sheet which is aided by the rear covering.

7 Claims, 1 Drawing Sheet

BATH PILLOW

BACKGROUND OF THE INVENTION

This invention relates to a pillow or cushion for use as a head rest in a bathtub and more particularly to a cushion of this type which may be readily attached and detached from a bathtub by suction cup means permanently secured within an outer covering of the cushion in a water tight sealed manner.

Bath cushions for use as a head rest have been proposed in the prior art for some time. Such cushions are shown in U.S. Pat. Nos. 2,461,880; 1,954,940 and 1,953,798 which are either of a sponge rubber material encased within a covering impervious to water or are merely a solid rubberized material. Also known is a cushion which is inflatable. Neither the solid material cushions nor the inflatable cushions are comfortable to a user and thus apparently have been commercially unsuccessful. Since the known cushions generally have suction cup means for removably attaching the cushion to the tub wall, difficulty exists with the covered sponge rubber cushion. The suction cups have been attached directly to the covering and thus after minimal use leakage occurs in the interface between the suction cups and the covering. In Curran U.S. Pat. No. 2,461,880 the suction cups were attached to straps bridging the rear of the cushion so as to avoid this problem. However, in this proposal the suction cups were attached with screws and bolts which were subjected to the effects of the bath water. Other examples of head rests and the like using suction cups attached in similar manner in a bathtub or basin environment are illustrated in U.S. Pat. Nos. 2,825,069; 2,167,178 and 2,161,590.

SUMMARY OF THE INVENTION

Consequently, it is a primary object of the present invention to provide a resilient bath pillow which may be removably attached to a bathtub to form a comfortable head rest for a bather.

It is another object of the present invention to provide a bath pillow having attachment means for readily and removably attaching the pillow to a bathtub for forming a resilient comfortable head rest, the attachment means being secured within an outer covering of the pillow.

It is a further object of the present invention to provide a pillow having an outer covering protecting a resilient interior, the pillow having attachment means for removably attaching the pillow to a bathtub, the attachment means being secured within the covering to a sheet fastened to the covering.

Accordingly, the present invention provides a comfortable bath pillow for use as a head rest within a bathtub, the pillow having a resilient material interior enclosed within an outer casing. Attachment means in the form of suction cups or the like are secured to a sheet securely disposed between a front and rear portion of the casing for removably attaching the pillow to a bathtub. The suction cups extend out the rear portion of the casing while the sheet and the front portion of the casing form a water impervious closure about the resilient inner material. The front end rear portion of the casing are formed from separate covering elements and the sheet is bonded to the periphery of both portions.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
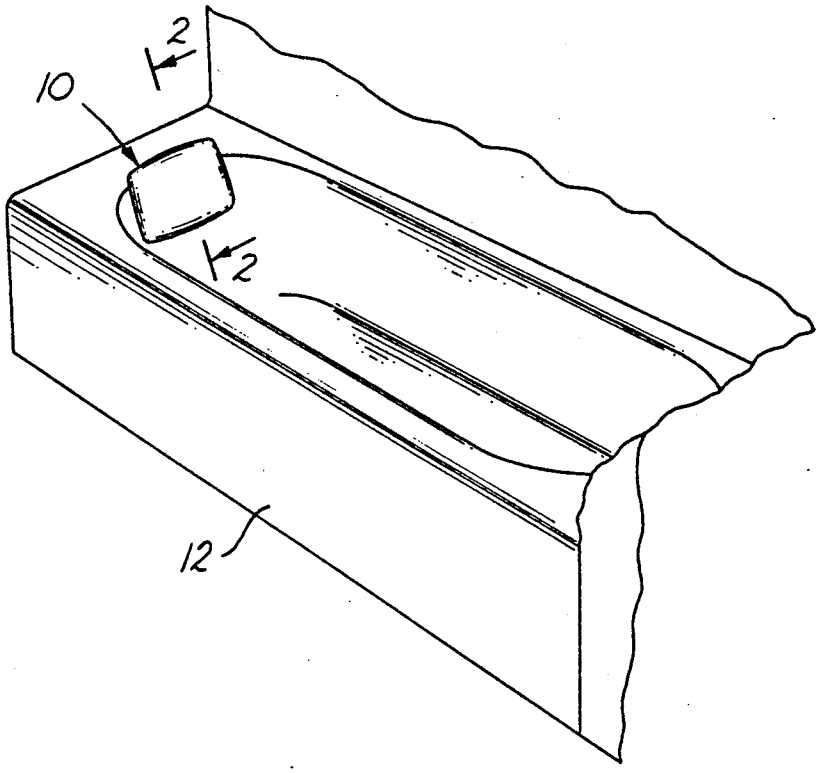
FIG. 1 is a fragmentary perspective view of a conventional bathtub illustrating a pillow constructed in accordance with the present invention attached thereto.
Figure 2:
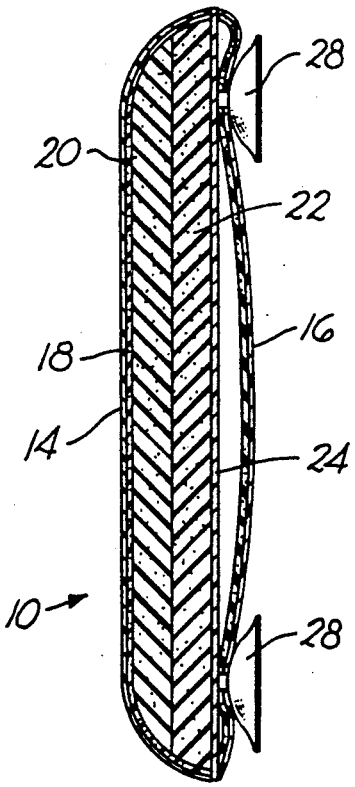
FIG. 2 is a cross sectional view taken substantially through the pillow along line 2—2 of FIG. 1.
Figure 3:
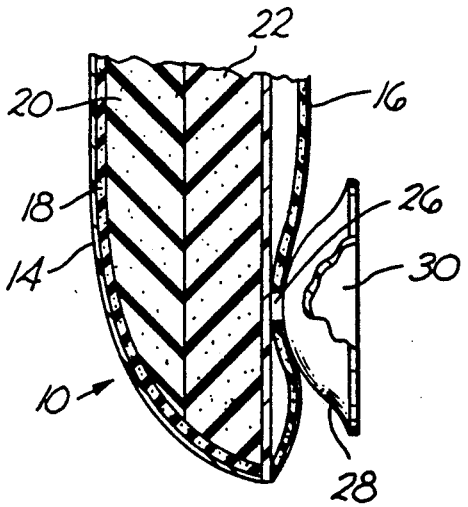
FIG. 3 is a fragmentary enlarged view of a portion of the pillow illustrated in FIG. 2.

As illustrated in FIG. 1, a pillow 10 constructed in accordance with the principals of the present invention is illustrated attached to a bathtub 12 and adapted for use as a head rest or the like, the pillow preferably having a generally rectangular configuration. As illustrated in FIG. 2, the pillow 10 includes an outer casing comprising a front covering 14 against which a person may rest his or her head while in the tub, and a rear covering 16 which faces the tub wall against which the pillow is attached. Preferably the front covering 14 is constructed from a soft polyvinylchloride (P.V.C.) vinyl material having a polyurethane coating, and the rear covering 16 is formed from an expanded vinyl also having a polyurethane coating, an open cell P.V.C. foam being glued to the interior surface of the front covering 14. The front and rear coverings are bonded together as hereinafter described about their respective peripheries.

Disposed within the outer casing are first and second blocks of polyurethane plastic foam 20, 22, each block having a different density, e.g. one being a A12 density foam and the other an A30 density foam, so as to provide a comfortable support when engaged by the head of a user. The thickness of each block is in the order of ¾ of an inch and the layers are laminated together by glue or the like. Positioned between the rear foam layer 22 and the rear covering 16 is a plastic sheet 24 formed from eight gauge extruded P.V.C. Disposed through openings in the rear covering 16 and bonded by dielectric sealing means to the rear surface of the sheet 24 are the stems or mounting portions 26 of four P.V.C. suction cups 28, only two of which are illustrated, there being one suction cup adjacent each corner of the rectangular pillow. The suction cups 28 have respective concave inner suction surfaces 30 which function in conventional manner for attachment to the smooth surface of the wall of the bathtub, the stems 28 being disposed on the outer convex surface of the cups.

In the construction of the pillow 10, four openings are formed through the rear covering 16. The stems 26 of the suction cups 28 are inserted into and through the openings. The P.V.C. sheet 24 is then disposed on the ends of the stems 26 of the suction cups 28 and is dielectrically bonded by conventional means thereto to seal the stems of the suction cups to the sheet 24. The front covering 14 having the foam lamination 18 on the interior thereof is positioned within a die cavity and the assembly of the blocks 20, 22 of the support foam is inserted into cavity upon the foam interior of the front covering. The back covering 16 having the suction cups and the attached sheet 24 trapped within the openings of the back covering is then placed upon the block 22.

With the sheet 24 disposed between the front covering 14 and the rear covering 16, the sheet and the coverings are dielectrically bonded together about the respective peripheries to seal the foam blocks 20, 22 between the front covering and the sheet in a water tight relationship. The sheet 14 is thus permanently bonded to the coverings and since the suction cups are bonded to the sheet the suction cups are not directly attached to the outer covering which would overload these vinyl materials when detaching the pillow from the tub. Attachment of the suction cups in this manner also acts to spread the pulling load on the extruded sheet 24 which acts against the rear covering 16 for support when the suction cups are pulled away from the bathtub wall. A single pin hole is thereafter formed in the rear of the pillow to permit the air trapped during the sealing process to escape so as to permit the pillow to conform to the shape of the head of a user.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims Having thus set forth the nature of the invention, what is claimed herein is:

1. A resilient pillow for use in a bathtub comprising a casing enclosing a resilient plastic foam filler defining the shape of said pillow, said casing including a front covering and a rear covering secured together at respective peripheral edges corresponding to a peripheral configuration of said pillow, a sheet disposed intermediate said front and rear coverings and secured to said peripheral edges, said sheet further being disposed intermediate said filler and said rear covering, a plurality of resilient suction cups, each suction cup having an inner suction surface and an external surface having a stem extending therefrom, each stem being disposed through an opening formed in said rear covering and secured to said sheet.

2. A pillow as recited in claim 1, wherein said front and rear coverings and said sheet comprise synthetic plastic material, and said coverings and said sheet are heat sealed together about said respective peripheral edges.

3. A pillow as recited in claim 2, wherein said filler comprises at least two blocks of polyurethane foam, each block having a different density.

4. A pillow as recited in claim 1, wherein said pillow comprises a rectangular shape including a suction cup disposed adjacent each corner of said rear covering.

5. A pillow as recited in claim 4, wherein said front and rear coverings and said sheet comprise synthetic plastic material, and said coverings and said sheet are heat sealed together about said respective peripheral edges.

6. A pillow as recited in claim 5, wherein said filler comprises at least two blocks of polyurethane foam, each block having a different density.

7. A pillow as recited in claim 6, wherein said suction cups comprise synthetic plastic material and said stems are heat sealed to said sheet.

* * * * *